United States Patent [19]

Gruber et al.

[11] Patent Number: 4,814,253

[45] Date of Patent: Mar. 21, 1989

[54] TONER COMPOSITIONS WITH RELEASE AGENTS THEREIN

[75] Inventors: Robert J. Gruber, Pittsford, N.Y.; Raymond A. Yourd, III, Cleveland Heights, Ohio; Shadi L. Malhotra, Mississauga, Canada; John G. Vandusen, Walworth, N.Y.

[73] Assignee: Xerox Corporation, Stamford, Conn.

[21] Appl. No.: 113,848

[22] Filed: Oct. 29, 1987

[51] Int. Cl.[4] ..... G03G 9/16

[52] U.S. Cl. ..... 430/106.6; 430/138

[58] Field of Search ..... 430/138, 110, 106.6

[56] References Cited

U.S. PATENT DOCUMENTS

| | | | |
|---|---|---|---|
| 3,485,787 | 12/1969 | Haefele et al. | 260/336 |
| 4,005,053 | 1/1977 | Briggs et al. | 260/336 AQ |
| 4,357,406 | 11/1982 | Kouchi et al. | 430/137 |
| 4,460,672 | 7/1984 | Gruber et al. | 430/110 |
| 4,517,272 | 5/1985 | Jadwin et al. | 430/110 |
| 4,533,616 | 8/1985 | Ohsaki et al. | 430/138 |

*Primary Examiner*—John L. Goodrow

*Attorney, Agent, or Firm*—E. O. Palazzo; J. L. Byoriuk

[57] ABSTRACT

Disclosed is an encapsulated toner composition comprised of (1) domains containing a polymer component having dispersed therein a release composition; and thereover (2) a host resin component comprised of toner resin particles and pigment particles.

30 Claims, No Drawings

TONER COMPOSITIONS WITH RELEASE AGENTS THEREIN

BACKGROUND OF THE INVENTION

This invention is generally directed to toner and developer compositions and to processes for the preparation thereof. More specifically, the present invention is generally directed to toner compositions comprised of toner particles containing an encapsulated component with a silicone oil therein. More specifically, the aforementioned toner compositions are comprised of toner resin particles and pigment particles that function as an encapsulating material for domains of certain polymers having entrapped therein mineral oils, silicone oils, or other similar release components. Moreover, the toner and developer compositions of the present invention can contain therein charge enhancing additives for the primary purpose of imparting positive charges to the toner resin particles enabling the use of these compositions in imaging systems wherein the photoresponsive imaging member is negatively charged. In addition, there can be added to the toner and developer compositions of the present invention other components such as colloidal silicas, metal salts of fatty acids or metal salts. The toner and developer compositions of the present invention are useful for affecting the development of images in electrophotographic imaging systems, and wherein the components associated with silicone oils are not required since the release agent is incorporated into polymer resin particles.

Numerous toner and developer compositions are known inclusive of those with waxes therein, reference for example British Pat. No. 1,442,835. The aforementioned patent illustrates toner compositions comprised of a styrene homopolymer or copolymer resin, and at least one polyalkylene compound. According to the disclosure of this patent, reference page 2, beginning at line 90, the starting polymer resin may be either a homopolymer of styrene, or a copolymer of styrene with other unsaturated monomers, specific examples of which are disclosed on page 3, beginning at line 1. Polyalkylene compounds selected for incorporation into the toner compositions disclosed in this patent include those of a low molecular weight, such as polyethylene, and polypropylenes of an average molecular weight of from about 2,000 to about 6,000.

Additionally, there is disclosed in U.S. Pat. No. 4,460,672, entitled "Positively Charged Toner Compositions", a developer composition mixture comprised of electrostatic toner particles consisting of resin particles, pigments particles, low molecular weight waxy materials with a molecular weight of from about 500 to about 20,000; and further included in the composition from about 0.5 percent by weight to about 10 percent by weight of a charge enhancing additive selected from, for example, alkyl pyridinium halides, organic sulfonate compositions, and organic sulfate compositions. The disclosure of this patent is totally incorporated herein by reference.

Also, there is disclosed in U.S. Pat. No. 4,206,247 a developer composition comprised of a mixture of resins including a low molecular weight polyolefin and alkyl modified phenol resins. More specifically, it is indicated in this patent, reference column 4, line 6, that the invention is directed to a process which comprises the steps of developing an image with toner particles containing in certain proportions at least one resin selected from group B, wherein the resins of group A include a low molecular weight polyethylene, a low molecular weight polypropylene, and similar materials; and wherein the group B resins include natural resin modified maleic acid resins, and natural modified pentaerythritol resins. As examples of group A resins there are mentioned polystyrene, styrene series copolymers, polyesters, epoxy resins, and the like, reference the disclosure in column 5, line 47. The molecular weight of the polypropylene or polyethylene used is from about 1,000 to about 10,000, and preferably from about 1,000 to about 5,000.

Moreover, developer compositions with charge enhancing additives, especially additives which impart a positive charge to the toner resin, are well known. Thus, for example, there is described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica. Additionally, in U.S. Pat. No. 3,893,935 there is described the utilization of certain quaternary ammonium salts, which when incorporated into a toner material, were found to provide a positive toner charge when mixed with a suitable carrier vehicle. There is also described in U.S. Pat. No. 4,298,672, the disclosure of which is totally incorporated herein by reference, positively charged toner compositions comprised of resin particles and pigment particles, and as a charge enhancing additive alkyl pyridinium compounds and their hydrates. Examples of alkyl pyridinium compounds disclosed in the '672 patent include cetyl pyridinium chloride. Also, there is illustrated in U.S. Pat. No. 4,338,390, the disclosure of which is totally incorporated herein by reference, positively charged developer compositions containing organic sulfate, and sulfonate compositions as charge enhancing additives.

In addition, there is illustrated in U.S. Pat. No. 4,517,272 electrostatic dry toner compositions comprising finely divided polymeric particles admixed with a silicone oil, reference for example, column 1, beginning at line 62, and continuing on to column 2, line 65. This patent, however, does not teach the utilization of an encapsulated toner thereby preventing undesirable agglomeration of the toner particles. Also, with respect to the '272 patent, there is no teaching therein with respect to the addition of large amounts of silicone oil to the toner composition, that is amounts exceeding 5 percent and up to 80 percent, and preferably from about 30 to about 50 percent as is the situation with the toner compositions of the present invention. Moreover, of interest are U.S. Pat. Nos. 3,485,787 directed to elastomeric compositions with hydrogenerated black copolymers and oils; 4,050,053 directed to polymer oils in carbon black master batches; and 4,357,406 disclosing developers for electrophotography comprising a continuous phase consisting of a homogeneous mixture of a resin and a pigment, and a dispersed phase consisting of spherical particles of a soft parting or fixing material of an emulsion dispersed in the continuous phase, reference the Abstract of the Disclosure.

Developer compositions can be selected for use in developing electrostatic images, wherein the toner image is fixed to a permanent substrate such as paper by contacting the paper with a roller, the surface of which is formed from a material capable of preventing toner particles from sticking thereto. In this process, however, the surface of the heated fixing roll is brought into contact with the toner image, thus a part of the toner image can adhere to and remain on the surface of the roll. This causes a part of the toner image to be transferred to the surface of a subsequent sheet on which the toner image is to be successively fixed, thereby causing the well known undesirable offset phenomena.

In order to substantially eliminate offsetting, and more specifically for the purpose of preventing adhesion of the toner particles to the surface of the fixing roller, there have been selected certain types of rollers, the surface of which may be covered with a thin film of an offset preventing liquid such as a silicone oil. These oils are highly effective, however, the apparatus within which they are incorporated is complicated and costly since, for example, a means for feeding the oil is required. Also, not only do the silicone oils emit an undesirable odor, but these oils deposit on the machine components causing toner particles to undesirably collect on, and adhere to the silicone oils. An accumulation of toner particles on machine components is troublesome in that image quality is adversely effected, and further these components must be periodically cleaned and/or replaced adding to the maintenance costs of the machine system involved.

Accordingly, there is a need for toner and developer compositions that can be selected for xerographic imaging apparatuses wherein silicone oil release devices are avoided. Additionally, there is a need for improved toner and developer compositions with stable triboelectric charging characteristics, and wherein offsetting is substantially avoided. There also is a need for improved toner and developer compositions which can be selected for the development and fixing of electrostatic latent images in electrophotographic imaging processes wherein the toner particles utilized are substantially free of agglomeration. Furthermore, there is a need for toner and developer compositions comprised of resin particles which have incorporated therein a release agent thereby preventing the release oil from migrating within the machine environment. There also remains a need for toner compositions which will not agglomerate or stick together when a release agent such as a mineral oil or silicone oil is included therein. Furthermore, there is a need for encapsulated, nonsticky toner compositions containing a host resin, and encapsulated therein a component with a mineral oil or silicone oil; and wherein there results subsequent to development of images the absence of any undesirable oil on the final copy.

SUMMARY OF THE INVENTION

It is an object of the present invention to provide toner and developer compositions with the above advantages.

In another object of the present invention there are provided toner compositions having incorporated therein release additives.

Additionally, in another object of the present invention there are provided toner compositions comprised of a host resin as an encapsulant for domains comprised of certain polymer resins, which contain therein and are entrapped thereby mineral oils, silicone oils, or mixtures thereof, which toner compositions further include therein pigment particles.

In yet still another object of the present invention there are provided toner and developer compositions, which can be selected for electrophotographic imaging processes wherein no silicone oil release devices are required.

Moreover, in yet an additional object of the present invention there are provided methods for developing electrostatic images with toner compositions containing therein entrapped silicone oils.

Also, in another object of the present invention there are provided encapsulated toner compositions with areas of domains containing a polymer component having dispersed or entrapped therein mineral oil or silicone oils, and wherein the resulting toner compositions enable developed images with substantialy no silicone oil present on the surface thereon subsequent to fixing in an electrostatic imaging apparatus.

These and other objects of the present invention are accomplished by providing toner and developer compositions wherein the toner compositions are comprised of (1) a host component comprised of toner resin particles and pigment particles; and (2) encapsulated therein domains comprised of a polymer having entrapped or dissolved therein release agents such as mineral oils or silicone oils. More specifically, in one embodiment of the present invention there are provided toner compositions comprised of (1) a host component containing styrene acrylate, styrene methacrylate, or styrene butadiene resin particles, and pigment particles of carbon black, magnetite or mixtures thereof; and (2) encapsulated therein domains comprised of styrene-butadiene-block polymers such as Kraton, styrene butadiene copolymers, or styrene siloxanes, which components have entrapped or dissolved therein mineral oils or silicone oils. With further respect to the present invention, in a preferred embodiment thereof the mineral oils are entrapped or present in the styrene butadiene blocks or styrene butadiene copolymers while the silicone oils are entrapped or present in the styrene siloxanes. Moreover, in a further embodiment of the present invention there can be included in the toner composition host resins, charge enhancing additives; and on the surface thereof external additives such as colloidal silicas, metal salts of fatty acids, metal salts, and mixtures thereof.

With the aforementioned toner compositions, there are achieved the advantages illustrated herein including nonagglomeration; the permanent retention of the mineral and/or silicone oils in the toner compositions until fixing of the image is affected thereby avoiding machine contamination; and final developed images with substantially no silicone or mineral oils deposited thereon.

The domains contained within the host resin can be comprised of various polymers providing that they will entrap or dissolve mineral oils, silicone oils, or mixtures thereof. Examples of the aforementioned materials include styrene butadiene block polymers available as Kraton, styrene butadiene copolymers; styrene siloxanes; and the like.

More specifically, the domains are comprised of from about 3 to about 25 percent by weight, and preferably from about 6 to about 15 percent by weight of styrene siloxane copolymers wherein the styrene segment has a weight average molecular weight of, for example, from about 20,000 to about 150,000, and preferably from about 30,000 to about 75,000; and wherein the siloxane segment has a weight average molecular weight of from about 1,000 to about 75,000, and preferably from about 3,000 to about 8,000, which resins have incorporated therein, or entrapped thereby, silicone oils in an amount of from abut 20 to about 80 percent, and preferably in an amount of from about 30 percent to about 50 percent by weight. In another embodiment of the present invention, the domains are comprised of Kraton polymers, for example Kraton 1,000 polymers available from Shell Chemical Company; styrene butadiene copolymers wherein, for example, the styrene segment has a weight average molecular weight of from about 20,000 to about 300,000, and the butadiene segment has a molecular weight of from about 30,000 to about 150,000, which resin is present in an amount of from about 3 to about 25 percent by weight, and preferably from about 6 to about 15 percent by weight, and wherein the aforementioned resins have contained therein, or entrapped therein, mineral oils in an amount of from about 20 percent by weight to about 80 percent by weight, and preferably from about 30 percent by weight to about 50 percent by weight.

The domains illustrated herein are encapsulated within a toner host material comprised of toner resin particles and pigment particles. Examples of toner resin particles that may be selected include styrene acrylates, styrene methacrylates, polyesters, vinyl resins, polyolefins, and the other resins illustrated herein. Specific resins are illustrated in the patents mentioned herein such as, for example, styrene methacrylates, styrene butadienes, and the polyesters as illustrated in U.S. Pat. Nos. 3,655,377 and 3,590,000, the disclosures of which are totally incorporated herein by reference.

Various suitable colorants and/or pigment particles may be selected including, for example, carbon black, Nigrosine dye, magnetic particles such as Mapico Black, a mixture of iron oxides, and the like. The pigment particles are present in sufficient quantities to render the resulting toner compositions highly colored enabling the formation of a visible image on a recording member. Thus, for example, the pigment particles, with the exception of magnetic materials, should be present in an amount of from about 2 percent by weight to about 15 percent by weight, and preferably from about 2 percent by weight to about 10 percent by weight. With regard to magnetic pigments such as Mapico Black, they are generally incorporated in an amount of from about 10 percent by weight to about 70 percent by weight, and preferably in an amount of from about 20 percent by weight to about 50 percent by weight.

While the magnetic particles can be present in the toner composition as the only pigment, these particles may be combined with other pigments such as carbon black. Thus, for example, in this embodiment of the present invention the other pigments, which are present in an amount of from about 10 percent by weight to about 15 percent by weight, are mixed with from about 10 to about 60 percent by weight of magnetic pigment. Other percentage combinations may be selected provided the objectives of the present invention are achieved.

As additional components, there can be incorporated into the host encapsulating resin compositions charge enhancing additives such as alkyl pyridinium halides inclusive of cetyl pyridinium chloride; distearyl dimethyl ammonium ethyl sulfate; organic sulfates and sulfonate compositions, reference the U.S. patents previously mentioned herein; and other similar additives. These additives are generally present in an amount of from about 0.1 percent by weight to about 10 percent by weight, and preferably are present in an amount of from about 1 percent by weight to about 5 percent by weight.

As external additives usually present in an amount of from about 0.1 to about 5 percent by weight there can be selected for the toner composition of the present invention colloidal silicas inclusive of Aerosil R972, reference U.S. Pats. Nos. 4,051,077 and 3,900,588, the disclosures of which are totally incorporated herein by reference; metal salts or metal salts of fatty acids, reference U.S. Pats. Nos. 3,590,000 and 3,655,374, the disclosures are totally incorporated herein by reference.

Various effective suitable methods may be selected for preparing the encapsulated toner compositions of the present invention including insitu polymerizations, and other similar methods. In insitu polymerization, the toner composition is generally prepared by admixing in the appropriate amounts water, a phosphate such as tricalcium phosphate, and an aliphatic alcohol such as methanol to which can be added a solution of the host resin and the domain resin containing the release fluid, which solution also contains a polymerization initiator such as an azo bis compound (AIBN), and the pigment particles such as carbon black. Thereafter, the mixture is heated generally at a temperature of from about 60° to about 70° C. for a sufficient period of time, for example 10 to 15 hours, until polymerization is completed. Subsequently, the product resulting, is cooled to room temperature, and acid such as nitric acid is added for acidification purposes, followed by filtering the product resulting washing with water, and drying. Thereafter, the resulting toner composition comprised of an encapsulating host polymer component containing toner resin particles and pigments particles, and domains comprised of the polymers particles having silicon oils and mineral oils entrapped therein can be micronized to yield a free flowing toner composition powder.

Illustrative examples of various carrier materials selected for admixing with the toner compositions illustrated herein enabling the formation of developers include those substances that are capable of triboelectrically obtaining a charge of opposite polarity to that of the toner particles including, for example, steel, iron, ferrites, and the like. These carriers can be used with or without a coating, which coatings can be comprised of fluoropolymers, including polyvinylidene fluoride commercially available from E.I. duPont Company, methyl terpolymers, polymethyl methacrylate, reference U.S. Pats. Nos. 3,467,634 and 3,526,533, the disclosures of which are totally incorporated herein by reference, and the like. Additionally, there can be selected nodular carrier beads of nickel characterized by surfaces of reoccurring recesses and protrusions, as described in U.S Pat. Nos. 3,847,604 and 3,767,598, the disclosures of which are totally incorporated herein by reference, thus providing particles with a relatively large external area. The diameter of the coated carrier particles is from about 50 microns to about 1,000 microns, thus allowing the carrier particles to possess sufficient density and inertia to avoid adherence to the electrostatic images during the development process.

The carrier particles are mixed with the toner composition in various suitable combinations, however, best results are obtained with from about 1 part by weight of toner particles to about 100 parts to 1,000 parts by weight of carrier particles. Preferred are developer compositions wherein the toner concentration varies from about 1 percent to about 5 percent.

Examples of imaging members that may be selected include various known photoreceptors, particularly those which are negatively charged, which usually occurs with organic materials including layered photoreceptor members. Illustrative examples of layered photoresponsive materials include those with a substrate, a generating layer, and a transport layer as described in U.S. Pat. No. 4,265,990, the disclosure of which is totally incorporated herein by reference. Examples of generating layers are trigonal selenium, metal phthalocyanines, metal free phthalocyanines, and vanadyl phthalocyanine, while examples of transport materials include various aryl amines dispersed in resinous binders. Other organic photoresponsive materials that may be utilized in the practice of the present invention include polyvinyl carbazole, 4-dimethylaminobenzylidene; 2-benzylidene-amino-carbazole; (2-nitrobenzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-trinitrofluorenone charge transfer complex; and mixtures thereof. Also, there may be selected as imaging members selenium, selenium alloys including selenium arsenic, selenium antimony, and other similar inorganic components inclusive of hydrogenated amorphous silicon imaging members.

The following examples are being supplied to further define specific embodiments of the present invention, it being noted that these examples are intended to illustrate and not limit the scope of the present invention. Parts and percentages are by weight unless otherwise indicated.

EXAMPLE I

Initially there was prepared a styrene dimethyl siloxane block copolymer, which copolymer is available commercially by the sequential anionic polymerization of styrene and hexamethyl chlorotrisiloxane. Thus, there was placed into a reaction vessel 1,200 grams of cyclohexane subsequent to distillation at the boiling point of cyclohexane from calcium hydride pellets, which distillation was accomplished at atmospheric pressure for the primary purposes of removing water and oxygen. Thereafter, there was added to the reaction vessel 208 grams of styrene subsequent to distillation at 40° C. and 10 millimeters of mercury from a suspension of calcium hydride in a nitrogen purged vessel. Initiation of polymerization was then accomplished by adding 3.8 milliliters of a stock solution of 1.3 molar secondary butyl lithium in cyclohexane. Thereafter, polymerization of the poly(styryllithium) was continued for one hour at 20° C. Subsequently, a solution of 150 grams of hexamethyl cyclotrisiloxane in 600 milliliters of tetrahydrofuran was then added to the reaction vessel with a syringe causing coupling with the styryllithium to occur rapidly followed by dimethyl siloxane polymerization over a 6 hour time period. Termination of the lithium silanolate polymerization was accomplished by addition of one gram of chlorotrimethyl silane to the reaction vessel, and thereafter isolation of the styrene/-dimethyl siloxane block copolymer was accomplished by precipitation of the reaction solution with 16 liters of methanol, and vacuum drying the desired solid polymer, yield 316 grams.

The weight average molecular weight of the styrene segment of the above-obtained block copolymer was about 41,600, while the weight average molecular weight for the polydimethyl siloxane segment for the block copolymer was about 10,000 as determined by size exclusion chromotography.

A toner composition was then prepared by an insitu polymerization process as follows: In a three-necked flask equipped with a stirrer, thermometer and reflux condenser was added 400 milliliters of water, 4 grams of the dispersing agent tricalcium phosphate, and 0.8 gram of the surfactant Alkanol$^R$ to which was added a solution of 53 grams of styrene, 37 grams of n-butylmethacrylate, 6 grams of the styrene dimethyl siloxane diblock copolymer prepared above, 3 grams of silicone oil, 1.8 grams of azobisisobutyl nitrile (AIBN), nd 5.34 grams of Raven 420 carbon black. The aforementioned mixture was then heated for 12 hours between 60° and 65° C., followed by cooling to room temperature, and thereafter nitric acid was added to the mixture. The mixture was filtered, the product washed with water, and dried; and there resulted a free flowing toner composition subsequent to micronization wherein the silicone oil was entrapped within the block copolymer, which component formed domains, and wherein the domains were encapsulated by a toner composition comprised of the styrene n-butylmethyacrylate copolymer and carbon black particles.

This toner was then incorporated into a Xerox Corporation 2830$^R$ imaging apparatus having incorporated therein a hard Teflon coated fuser oil, and wherein the fuser oil wicking device was removed; and there resulted excellent images with substantially no background deposits; and further, no offsetting occurred on the fuser roll surface. During the fusing process, some of the silicone oil present in the polymer domain was released. The fusing latitude, that is the difference between the minimum fix temperature and the hot offset temperature to the roll, was 50° F.

EXAMPLE II

A toner composition similar to that of Example I was prepared by melt blending 62.3 grams of styrene butadiene containing 89 percent by weight of styrene and 11 percent by weight of butadiene, Regal 330$^R$ carbon black, 4.2 grams (6 percent by weight), and a preblend of a styrene siloxane block copolymer as prepared in Example I (50,000 molecular weight for the styrene segment, 5,000 molecular weight for the siloxane segment), 2.8 grams, 4 percent by weight, and 0.07 gram, 1 percent by weight, of a silicone fuser oil commercially utilized in the Xerox Corporation 9200$^R$ imaging apparatus. The blending was accomplished on a laboratory plastograf at 100° C. A preblend was prepared by dissolving the aforementioned block copolymer in silicone oil and cyclohexane, followed by evaportion under vacuum to yield a free flowing polymer, reference Example I. The cooled toner composition was rough crushed and then micronized to approximately 10 microns average size particle diameter, and thereafter 0.5 percent of Aerosil was added as an external added Images were then developed by repeating the procedure of Example I, and substantially similar results were obtained.

Other modifications of the present invention will occur to those skilled in the art based upon a reading of the present disclosure. These are intended to be included within the scope of this invention.

What is claimed is:

1. A free flowing toner composition with substantially no offset when selected for an imaging process wherein a release agent is absent comprised of (1) an encapsulating host component containing toner resin particles and pigment particles; and (2) domains therein comprised of a polymer component having silicone oils or mineral oils entrapped therein, and wherein the polymer component is selected from the group consisting of styrene methacrylates, styrene butadienes, styrene butadiene block copolymers, and styrene siloxane copolymers.

2. A composition in accordance with claim 1 wherein the domains are comprised of a styrene siloxane copolymer with about 75 percent by weight of styrene.

3. A composition in accordance with claim 1 wherein the domains are comprised of styrene butadiene copolymers with from about 80 to about 90 percent by weight of styrene.

4. A composition in accordance with claim 1 wherein the entrapped component is a silicone oil.

5. A composition in accordance with claim 1 wherein the entrapped component is a mineral oil.

6. A composition in accordance with claim 1 wherein the toner resin particles are selected from the group consisting of styrene acrylates, styrene methacrylates, and styrene butadienes.

7. A composition in accordance with claim 1 wherein the pigment particles are selected from the group consisting of carbon black, magnetites, or mixtures thereof.

8. A composition in accordance with claim 1 containing therein charge enhancing additives.

9. A composition in accordance with claim 1 containing as external components colloidal silicas.

10. A composition in accordance with claim 1 containing as external components metal salts or metal salts of fatty acids.

11. A composition in accordance with claim 1 wherein the release agent is present in an amount of from about 20 percent by weight to about 80 percent by weight.

12. A developer composition comprised of the toner composition of claim 1, and carrier particles.

13. A developer composition in accordance with claim 12 wherein the carrier particles contain a polymeric coating thereover.

14. A developer composition in accordance with claim 12 wherein the carrier particles consist of a steel core.

15. A developer composition in accordance with claim 12 wherein the polymeric coating is selected from the group consisting of fluoropolymers and terpolymers of styrene methacrylate and an organosiloxane.

16. A method for developing images which comprises forming electrostatic latent images on a photoconductive imaging member, contacting the image with the toner composition of claim 2, followed by transferring the image to a suitable substrate, and permanently affixing the image thereto.

17. A method of imaging in accordance with claim 16 wherein there results images with no release agent present on the surface thereof.

18. A method of imaging in accordance with claim 16 wherein the domains are comprised of a styrene siloxane copolymer with about 75 percent by weight of styrene.

19. A method of imaging in accordance with claim 16 wherein the domains are comprised of styrene butadiene copolymers with from about 80 to about 90 percent by weight of styrene.

20. A method of imaging in accordance with claim 16 wherein the entrapped component is silicone oil.

21. A method of imaging in accordance with claim 16 wherein the entrapped component is a mineral oil.

22. A method of imaging in accordance with claim 16 wherein the encapsulating toner resin particles are selected from the group consisting of styrene acrylates, styrene methacrylates, and styrene butadienes.

23. A method of imaging in accordance with claim 16 wherein the pigment particles are selected from the group consisting of carbon black, magnetites, or mixtures thereof.

24. A method of imaging in accordance with claim 16 wherein the release agent is present in an amount of from about 20 percent by weight to about 80 percent by weight.

25. A composition in accordance with claim 2 wherein the domain polymer is a styrene siloxane copolymer wherein the styrene segment has a weight average molecular weight of from about 20,000 to about 150,000, and the siloxane segment has a weight average molecular weight of from about 1,000 to about 75,000, and the release composition is a silicone oil.

26. A composition in accordance with claim 2 wherein the domain polymer is a styrene butadiene block copolymer, and the release agent is a mineral oil.

27. A composition in accordance with claim 2 wherein the domain polymer is a styrene butadiene copolymer wherein the styrene segment has a weight average molecular weight of from about 20,000 to about 300,000, and the butadiene segment has a weight average molecular weight of from about 30,000 to about 150,000, and wherein the release composition is a mineral oil.

28. A composition in accordance with claim 2 wherein the toner includes charge enhancing additives.

29. A composition in accordance with claim 1 formed by blending the polymer component and the silicone or mineral oils, mixing the blended product with the pigment particles and the toner resin particles, melt blending the resulting mixture, cooling the mixture, and generating particles by crushing and micronizing the mixture.

30. A composition in accordance with claim 1 formed by mixing the polymer component, the silicone or mineral oils, the pigment particles, and at least two monomers, polymerizing the monomers to form the toner resin, cooling the mixture, and generating particles by crushing and micronizing the mixtures.

* * * * *